US010494781B2

(12) United States Patent
Leahy et al.

(10) Patent No.: US 10,494,781 B2
(45) Date of Patent: Dec. 3, 2019

(54) SIGNPOST JOINT

(71) Applicant: Xcessories Squared Development & Manufacturing Co., Inc., Auburn, IL (US)

(72) Inventors: Matthew Edward Leahy, Auburn, IL (US); Gregory Alan Kirchgesner, Auburn, IL (US)

(73) Assignee: XCESSORIES SQUARED DEVELOPMENT & MANUFACTURING CO., INC., Auburn, IL (US)

( * ) Notice: Subject to any disclaimer, the term of this patent is extended or adjusted under 35 U.S.C. 154(b) by 0 days.

(21) Appl. No.: 15/070,204

(22) Filed: Mar. 15, 2016

(65) Prior Publication Data

US 2017/0268188 A1 Sep. 21, 2017

(51) Int. Cl.

| | |
|---|---|
| ***E01F 9/631*** | (2016.01) |
| ***G09F 7/00*** | (2006.01) |
| ***G09F 15/00*** | (2006.01) |
| ***G09F 19/22*** | (2006.01) |
| *G09F 7/18* | (2006.01) |

(52) U.S. Cl.

CPC ..... *E01F 9/631* (2016.02); *G09F 7/00* (2013.01); *G09F 15/0037* (2013.01); *G09F 19/22* (2013.01); *G09F 2007/1856* (2013.01)

(58) Field of Classification Search

CPC .. E01F 9/631; E01F 9/635; F16D 9/08; F16D 9/06

See application file for complete search history.

(56) References Cited

U.S. PATENT DOCUMENTS

| | | | | | |
|---|---|---|---|---|---|
| 3,002,775 | A | * | 10/1961 | Mueller | E03B 9/00 137/68.14 |
| 3,381,427 | A | * | 5/1968 | Watson | E01F 9/635 52/296 |
| 3,951,556 | A | | 4/1976 | Strizki | |
| 3,967,906 | A | | 7/1976 | Strizki | |
| 4,071,970 | A | | 2/1978 | Strizki | |
| 4,105,350 | A | | 8/1978 | O'Donnell | |
| 4,310,979 | A | | 1/1982 | Bloom | |
| 4,923,319 | A | * | 5/1990 | Dent | F16D 9/06 285/3 |
| 4,926,592 | A | * | 5/1990 | Nehls | E01F 9/681 256/13.1 |
| 5,481,835 | A | * | 1/1996 | Bloom | E01F 9/635 248/548 |
| 5,855,443 | A | * | 1/1999 | Faller | E01F 9/635 248/548 |
| 6,113,055 | A | * | 9/2000 | Salman | E01F 9/635 248/548 |

(Continued)

FOREIGN PATENT DOCUMENTS

WO 2007135119 A1 11/2007

*Primary Examiner* — David R Dunn
*Assistant Examiner* — Christopher E Veraa
(74) *Attorney, Agent, or Firm* — Armstrong Teasdale LLP

(57) ABSTRACT

A joint for a signpost having a first segment and a second segment is provided. The joint includes a first cap for the first segment, a second cap for the second segment, and a multi-directional hinge coupleable between the first cap and the second cap. The hinge is pivotable to facilitate lateral movement of the first cap relative to the second cap.

12 Claims, 7 Drawing Sheets

(56) References Cited

U.S. PATENT DOCUMENTS

| | | | | |
|---|---|---|---|---|
| 6,210,066 | B1 * | 4/2001 | Dent | E01F 9/635<br>248/548 |
| 6,308,927 | B1 * | 10/2001 | Leahy | E01F 9/635<br>248/530 |
| 6,959,902 | B2 * | 11/2005 | Leahy | E01F 9/631<br>248/530 |
| 7,434,778 | B2 * | 10/2008 | Leahy | E01F 9/631<br>248/530 |
| 7,537,412 | B2 | 5/2009 | Lewis | |
| 7,748,681 | B2 * | 7/2010 | Dent | G09F 15/00<br>248/548 |
| 7,980,533 | B1 | 7/2011 | Anderson et al. | |
| 8,303,209 | B2 | 11/2012 | Lewis | |
| 2011/0107585 | A1 * | 5/2011 | Hahin | F16B 31/021<br>29/525.11 |

* cited by examiner

SIGNPOST JOINT

BACKGROUND

The field of this disclosure relates generally to sign structures and, more particularly, to support posts and associated joints for sign structures.

Many known road sign structures are erected from the ground alongside a roadway, such that the structures are at risk of being impacted by vehicles. For example, at least some known road sign structures have a panel that is coupled to a plurality of support posts erected from the ground, and one of the support posts is typically positioned closer to the roadway than the other support post(s). When a vehicle collides with such a structure, the vehicle tends to initially impact the support post nearest the roadway, such that the support post detaches from its foundation. However, the detached support post tends to remain in the path of the vehicle for an undesirable period of time. This increases the likelihood of damaging, and injuring occupant(s) of, the vehicle that collided with the structure, as wells other vehicles in the vicinity of the collision.

BRIEF DESCRIPTION

In one aspect, a joint for a signpost having a first segment and a second segment is provided. The joint includes a first cap for the first segment, a second cap for the second segment, and a multi-directional hinge coupleable between the first cap and the second cap. The hinge is pivotable to facilitate lateral movement of the first cap relative to the second cap.

In another aspect, a signpost is provided. The signpost includes a first segment, a second segment, and a joint coupled between the first segment and the second segment. The joint includes a first cap coupled to the first segment, a second cap coupled to the second segment, and a multi-directional hinge coupled between the first cap and the second cap. The hinge is pivotable to facilitate lateral movement of the first cap relative to the second cap.

In another aspect, a sign structure is provided. The sign structure includes a panel and at least one support post coupled to the panel. The at least one support post has a first segment, a second segment, and a joint coupled between the first segment and the second segment. The joint includes a first cap coupled to the first segment, a second cap coupled to the second segment, and a multi-directional hinge coupled between the first cap and the second cap. The hinge is pivotable to facilitate lateral movement of the first cap relative to the second cap.

DETAILED DESCRIPTION

The following detailed description illustrates a signpost joint by way of example and not by way of limitation. The description should enable one of ordinary skill in the art to make and use the signpost joint, and the description describes several embodiments of the signpost joint, including what is presently believed to be the best modes of making and using the signpost joint. An exemplary signpost joint is described herein as being used on a road sign structure. However, it is contemplated that the signpost joint has general application to a broad range of systems in a variety of fields other than road sign structures.

Figure 1:
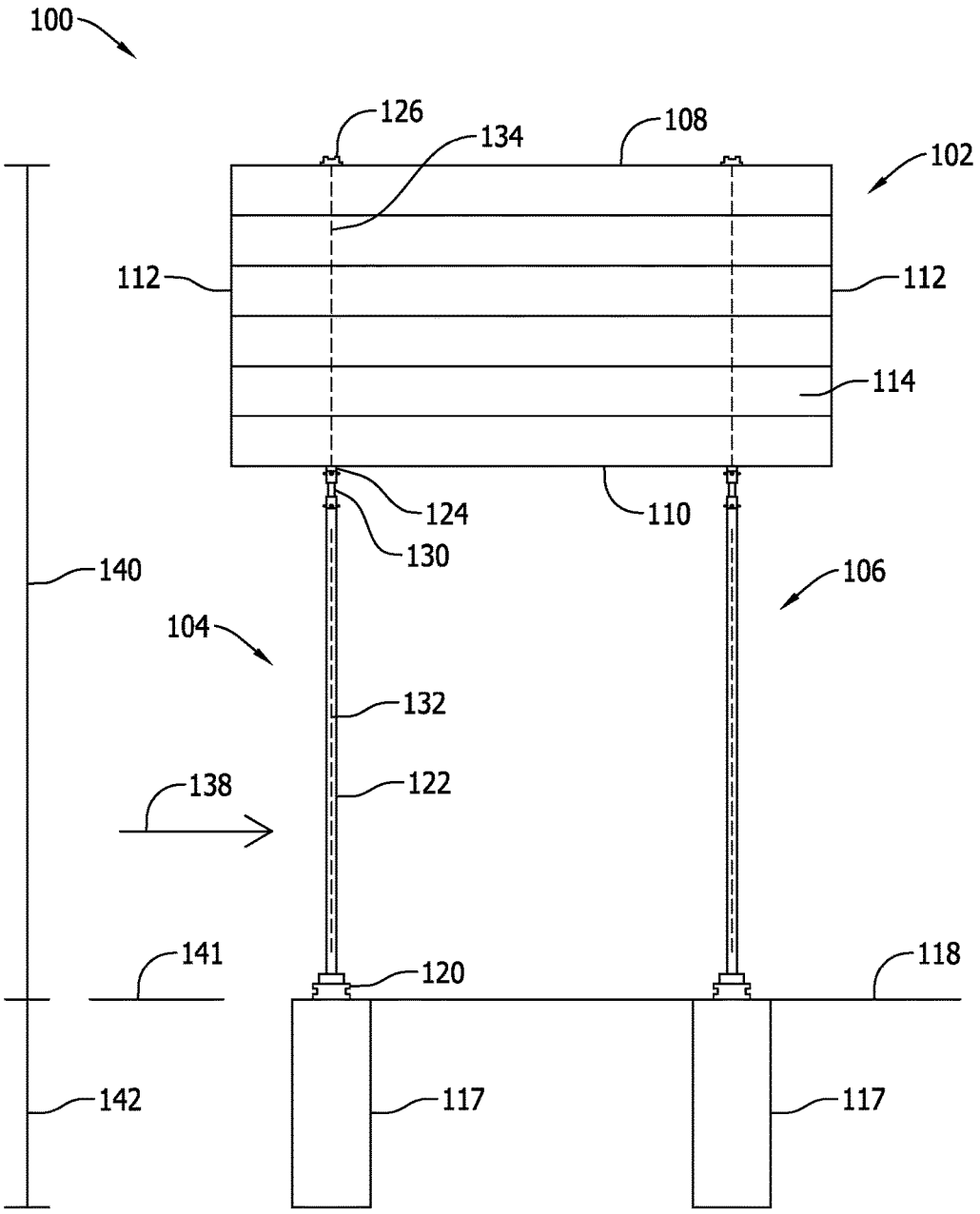
FIG. 1 is a front view of an exemplary sign structure.

FIG. 1 is a front view of an exemplary sign structure 100. In the exemplary embodiment, sign structure 100 is a road sign structure that includes a panel 102 and at least one support post to which panel 102 is coupled, namely a first support post 104 and a second support post 106. Panel 102 is substantially rectangular and has a top edge 108, a bottom edge 110, a pair of side edges 112, a front face 114, and a back face 116 (shown in FIG. 2). Front face 114 may have suitable indicia (not shown) printed thereon or coupled thereto (e.g., a highway exit number, the name of the cross-street at the exit, the distance to the exit, etc.). Although sign structure 100 has two support posts 104 and 106 in the exemplary embodiment, sign structure 100 may have any suitable number of support posts in other embodiments.

In the exemplary embodiment, each support post 104 and 106 is made of a metallic material (e.g., a steel material) and is erected from a foundation 117 embedded in the ground 118. Each support post 104 and 106 includes a base 120, a first (e.g., lower) segment 122, a second (e.g., upper) segment 124, and an end (e.g., top) 126. Base 120 is partly embedded in, or suitably coupled to, foundation 117 such that base 120 projects from foundation 117 to permit a vehicle (not shown) to pass over base 120 without base 120 damaging the undercarriage of the vehicle, or otherwise snagging the undercarriage of the vehicle in a manner that causes rapid deceleration of the vehicle, which could increase the risk of injury to occupant(s) of the vehicle. First segment 122 is coupled to base 120 and extends from base 120 to a joint 130 along a lengthwise first axis 132, such that first segment 122 is coupled to second segment 124 at joint 130. Second segment 124 extends from joint 130 to end 126 along a lengthwise second axis 134, such that second segment 124 is coupled to back face 116 of panel 102 via a plurality of brackets 136 (shown in FIG. 2).

Thus, first segment 122 and second segment 124 are substantially coaxially aligned across joint 130 in a substantially plumb (or vertical) orientation to suspend panel 102 above ground 118. Notably, base 120 is a multi-directional (e.g., omni-directional) slip-type base designed to permit detachment of post first segment 122 from foundation 117 in response to a lateral force 138 imparted on post first segment 122. Although each support post 104 and 106 has only one joint 130 in the exemplary embodiment, support posts 104 and/or 106 may have any suitable number of joints in other embodiments. Moreover, although post first segment 122 and post second segment 124 have substantially polygonal (e.g., substantially square or substantially rectangular) cross sections (as shown in FIG. 2), post first segment 122 and post second segment 124 may have any suitable cross-sectional shapes in other embodiments.

In the exemplary embodiment, each support post 104 and 106 is designed to have an above-grade length 140 from near base 120 to end 126, and a large percentage of length 140 is defined by post first segment 122 (e.g., post first segment 122 defines nearly fifty percent of length 140 in the exemplary embodiment, such that post first segment 122 is longer than the height of a vehicle traveling on an adjacent roadway 141). Moreover, in the exemplary embodiment, post second segment 124 extends only a marginal distance (e.g., a few inches) above panel top edge 108, and a marginal distance (e.g., less than an inch) below panel bottom edge 110, such that joint 130 is positioned adjacent to panel bottom edge 110. Notably, in some embodiments, post first segment 122 may be shorter than the height of a vehicle traveling on the adjacent roadway 141 if, for example, support posts 104 and/or 106 are positioned on an upslope in grade adjacent to the roadway 141.

For example, in one embodiment, foundation 117 may have a length 142 of about forty-eight inches, and panel 102 may have a height (from panel bottom edge 110 to panel top edge 108) of about seventy-two inches. Each support post 104 and 106 may, therefore, be designed such that above-grade length 140 is about one hundred and fifty-six inches, with base 120 defining about three inches of length 140, post first segment 122 defining about sixty-five inches of length 140, joint 130 defining about sixteen inches of length 140, and post second segment 124 defining about seventy-two inches of length 140. In other embodiments, each support post 104 and 106, and each of its components, may have any suitable length(s) that facilitate enabling joint 130 to function as described herein.

Figure 2:
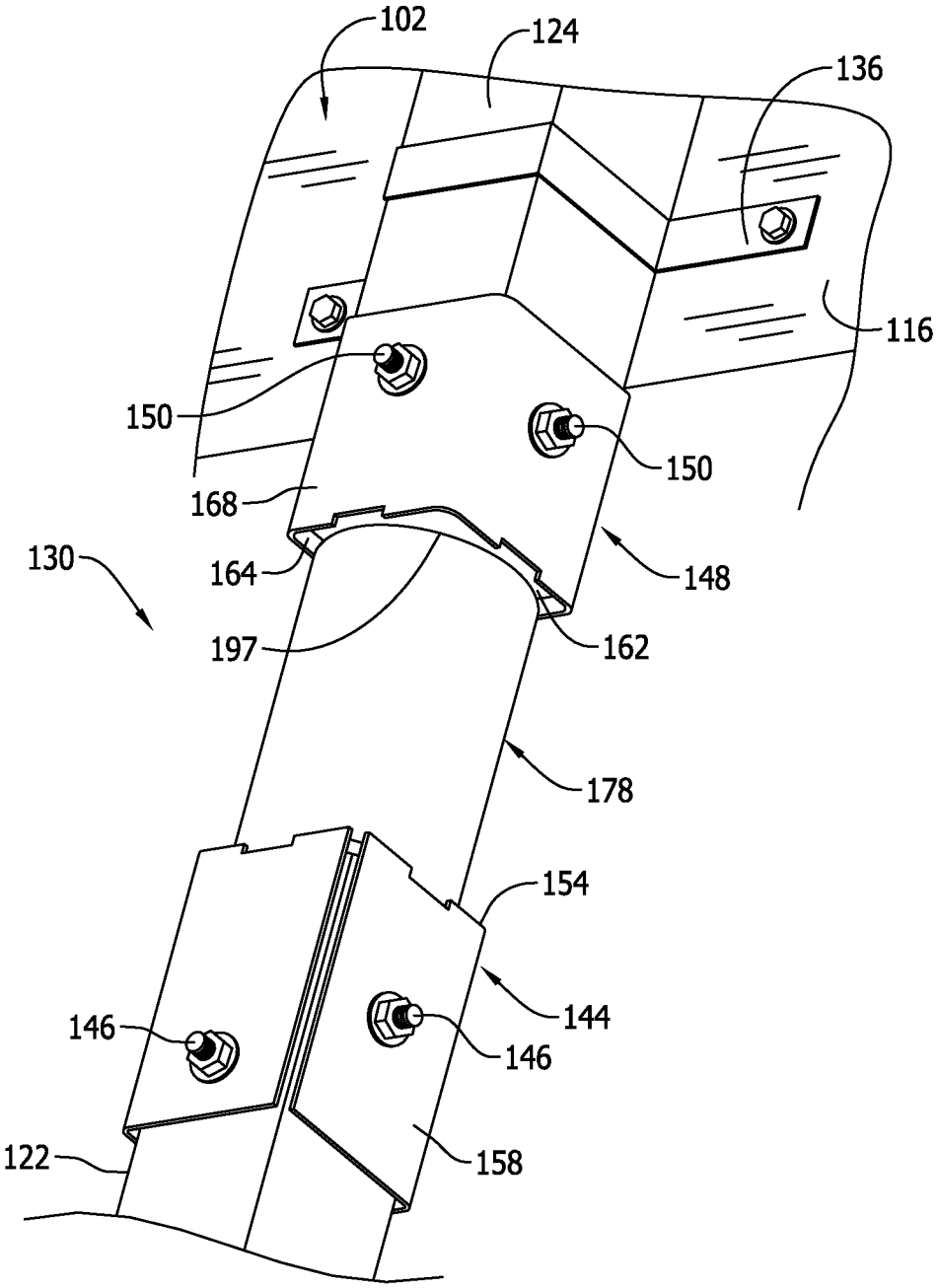
FIG. 2 is a back perspective view of a joint on a support post of the sign structure shown in FIG. 1.
Figure 3:
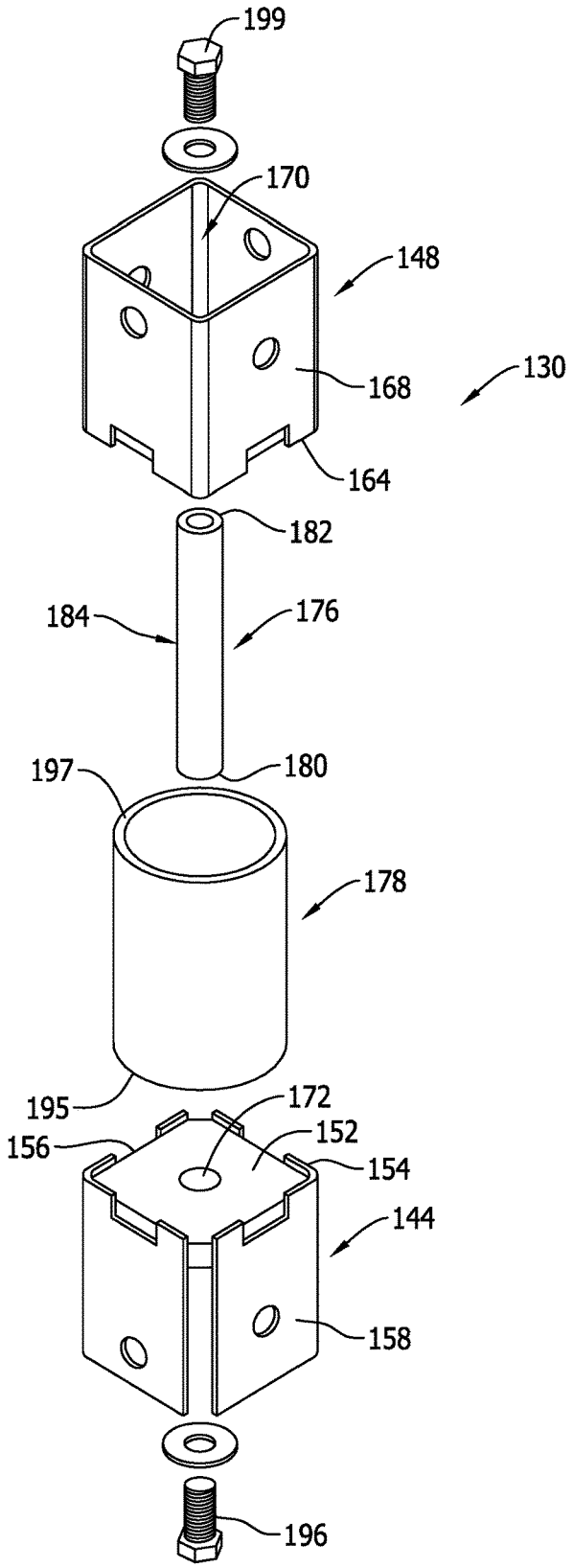
FIG. 3 is an exploded view of the joint shown in FIG. 2.
Figure 4:
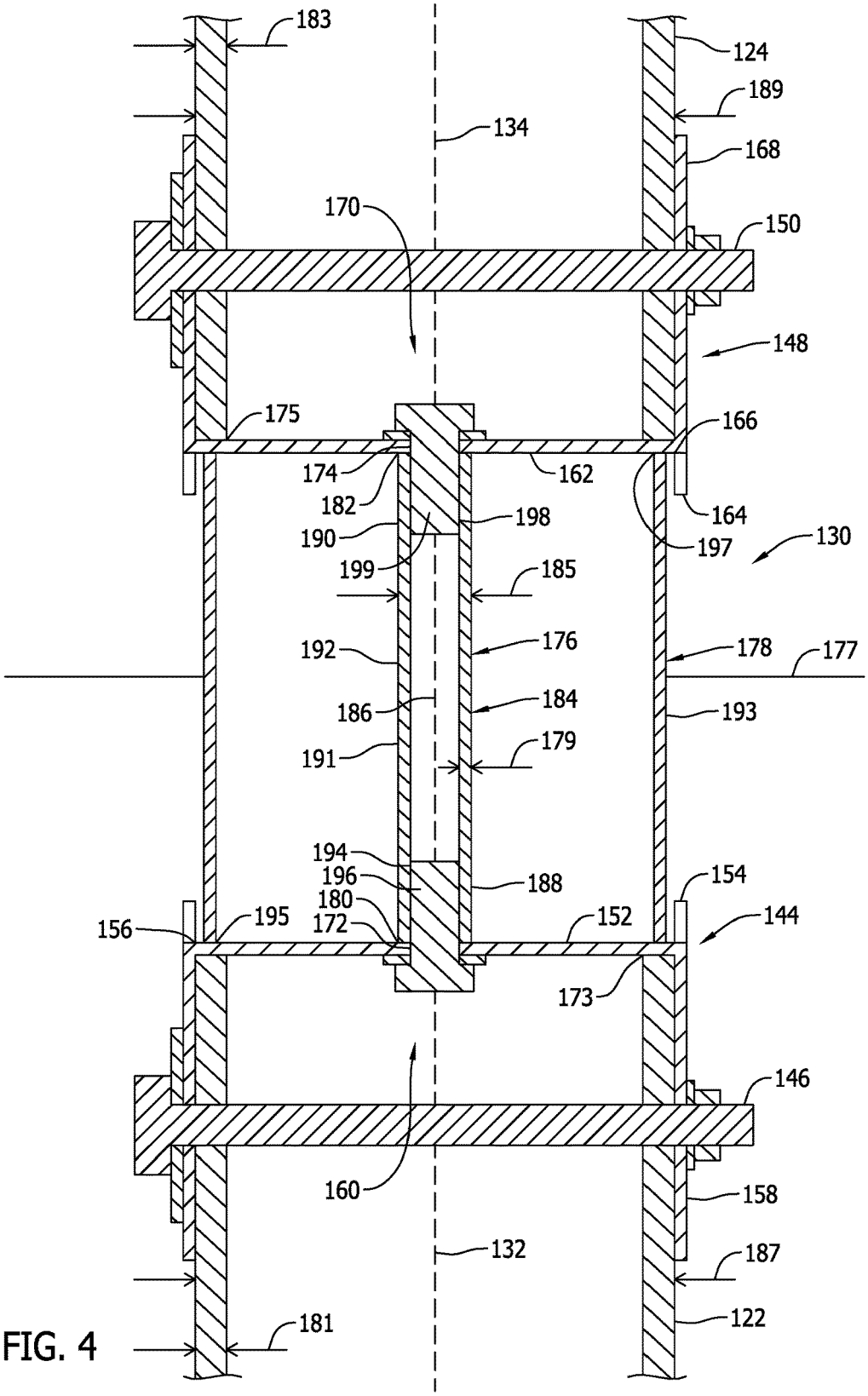
FIG. 4 is a cross-sectional view of the joint shown in FIG. 2.
Figure 5:
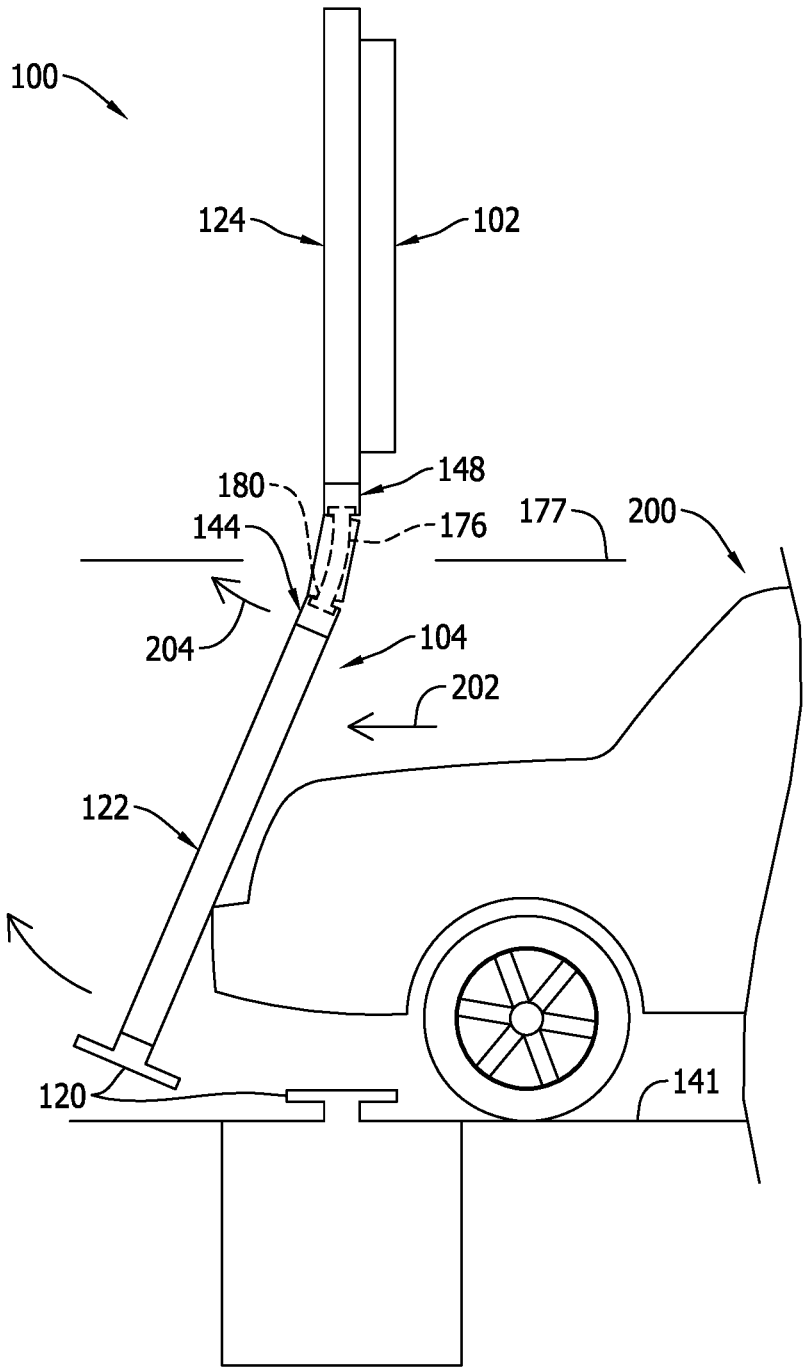
FIG. 5 is a side schematic illustration of a vehicle colliding with the sign structure shown in FIG. 1 during an initial stage of the collision.

FIGS. 2-4 are perspective, exploded, and cross-sectional views, respectively, of a joint 130. In the exemplary embodiment, joints 130 of support posts 104 and 106 have the same construction, and each joint 130 includes a first cap 144 coupled to a first (or upper) end 173 of post first segment 122 via at least one first fastener assembly 146, and a second cap 148 coupled to a second (or lower) end 175 of post second segment 124 via at least one second fastener assembly 150. First cap 144 has a first plate 152, a first lip 154 extending upward from first plate 152 near the periphery 156 of first plate 152, and a first sidewall 158 extending downward from first plate 152 to define a first socket 160 that receives post first segment 122 such that first plate 152 is oriented substantially perpendicular to first axis 132. Similarly, second cap 148 has a second plate 162, a second lip 164 extending downward from second plate 162 near the periphery 166 of second plate 162, and a second sidewall 168 extending upward from second plate 162 to define a second socket 170 that receives post second segment 124 such that second plate 162 is oriented substantially perpendicular to second axis 134. First plate 152 has a first aperture 172 that communicates with first socket 160, and second plate 162 has a second aperture 174 that communicates with second socket 170.

Optionally, each lip 154 and 164 may be a single, continuous lip that extends about the entire periphery 156 and 166 of its respective plate 152 and 162, or each lip 154 and 164 may have a plurality of lip segments that are spaced apart from one another about the periphery 156 and 166 of its respective plate 152 and 162 (as shown in FIGS. 2-4). Likewise, each sidewall 158 and 168 may optionally be a single, continuous sidewall that extends about the entire periphery 156 and 166 of its respective plate 152 and 162, or each sidewall 158 and 168 may have a plurality of sidewall segments that are spaced apart from one another about the periphery 156 and 166 of its respective plate 152 and 162. Moreover, although apertures 172 and 174 are centrally located on their respective plates 152 and 162 in the exemplary embodiment, apertures 172 and 174 may have any suitable locations that facilitate enabling joint 130 to function as described herein.

In the exemplary embodiment, joint 130 also includes a hinge (e.g., a rod 176) and a sleeve 178. Rod 176 has a first end 180, a second end 182, and a body 184 that extends from first end 180 to second end 182 along a lengthwise rod axis 186. Body 184 has a first (or lower) region 188 near first end 180, a second (or upper) region 190 near second end 182, and a middle region 192 between first and second regions 188 and 190, respectively. Rod first end 180 defines a first threaded bore 194 that receives a first fastener 196 via first aperture 172 of first plate 152 to seat rod first end 180 against (or position rod first end 180 adjacent to) first plate 152. Similarly, rod second end 182 defines a second threaded bore 198 that receives a second fastener 199 via second aperture 174 of second plate 162 to seat rod second end 182 against (or position rod second end 182 adjacent to) second plate 162. As such, rod axis 186 is substantially coaxially aligned with first axis 132 of post first segment 122 and second axis 134 of post second segment 124, such that post first segment 122 and post second segment 124 are in substantially coaxial alignment with on another across joint 130. Although rod 176 is hollow from its first end 180 to its second end 182 in the exemplary embodiment, rod 176 may not be hollow between first threaded bore 194 and second threaded bore 198 in some embodiments.

Moreover, sleeve 178 has a first end 195 and a second end 197, and rod 176 extends through sleeve 178 from its first end 195 to its second end 197 such that sleeve 178 envelops (e.g., circumscribes) rod 176 in spaced relation. Sleeve first end 195 is seated against first plate 152 of first cap 144, and sleeve second end 197 is seated against second plate 162 of second cap 148. As such, sleeve 178 facilitates supporting post first segment 122 and post second segment 124 in substantially coaxial alignment across joint 130. Notably, sleeve 178 is not fastened to first cap 144 or second cap 148 but, rather, sleeve 178 is held between first cap 144 and second cap 148 as a result of a clamping force imparted on sleeve 178 by first plate 152 and second plate 162, respectively. Post first segment 122 and post second segment 124 are, therefore, coupled together only by rod 176, and not by sleeve 178.

As a result, because first fastener 196 and second fastener 199 are rotatable within their respective apertures 172 and 174, post first segment 122 (and first cap 144) are rotatable relative to post second segment 124 (and second cap 148) about rod axis 186, during which post first segment 122, post second segment 124, and rod 176 are maintained in substantially coaxial alignment. In that regard, first lip 154 of first cap 144 is sized to overlap sleeve first end 195, and second lip 164 of second cap 148 is sized to overlap sleeve second end 197, to facilitate maintaining a pre-set lateral position of sleeve 178 between plates 152 and 162 and a pre-set lateral spacing between sleeve 178 and rod 176. Although rod 176 and sleeve 178 are generally cylindrical (e.g., their respective exterior surfaces 191 and 193 have annular cross-sectional shapes) in the exemplary embodiment, rod 176 and sleeve 178 may have any suitable shapes in other embodiments (e.g., their respective exterior surfaces 191 and 193 may have substantially square or substantially rectangular cross-sectional shapes in other embodiments).

In the exemplary embodiment, rod 176 is designed to have a yield strength that is less than that of post first segment 122 and post second segment 124. For example, in one embodiment, rod 176 may be made of a different material than post first segment 122 and/or post second segment 124. In another embodiment, rod 176 may have an outer diameter 185 that is less than a first outer width 187 of post first segment 122, and/or a second outer width 189 of post second segment 124 (e.g., outer diameter 185 may be less than half (e.g., about twenty-five percent) of first outer width 187 and/or second outer width 189). In yet another embodiment, rod 176 may have a wall thickness 179 that is less than a first wall thickness 181 of post first segment 122, and/or a second wall thickness 183 of post second segment 124. Alternatively, rod 176 may have any suitable size, shape, and/or material property that provides rod 176 with a yield strength that is less than that of post first segment 122 and/or post second segment 124.

Constructed in this manner, each joint 130 effectively defines a laterally weakened section of its respective support post 104 and 106, that is less capable of withstanding lateral force 138, particularly if lateral force 138 is imparted on the respective post first segment 122. Thus, when the magnitude of lateral force 138 imparted on post first segment 122 exceeds the yield strength of rod 176, joint 130 is designed to initially hinge (e.g., turn, bend, or buckle) at rod 176. For example, when a lateral force 138 in excess of the yield strength of rod 176 is imparted on post first segment 122, rod 176 hinges at middle region 192 of rod body 184, such that rod first end 180 pivots relative to rod second end 182 about middle region 192 and towards a plane 177 that extends through (or above) middle region 192 and that is oriented substantially perpendicular to second axis 134 of post second segment 124. Moreover, because rod axis 186 is oriented vertically (e.g., in substantially coaxial alignment with first axis 132 of post first segment 122 and second axis 134 of post second segment 124), rod first end 180 can pivot towards plane 177 in any lateral direction (i.e., in 360° about rod axis 186 at middle region 192) in response to a lateral force 138 imparted on post first segment 122. As used herein, the term "lateral" or any variation thereof is a modifier which refers to any direction having a component that is substantially parallel with plane 177.

In the exemplary embodiment, joint 130 is, therefore, a multi-directional (e.g., omni-directional) hinge-type joint that permits post first segment 122 to pivot relative to post second segment 124 as a result of a lateral force 138 imparted on post first segment 122, as set forth in more detail below. As used herein, the term "multi-directional" or any variation thereof is a modifier which refers to permitting lateral movement in at least two directions along plane 177, and the term "omni-directional" or any variation thereof is a modifier which refers to permitting lateral movement in all directions along plane 177.

Figure 6:
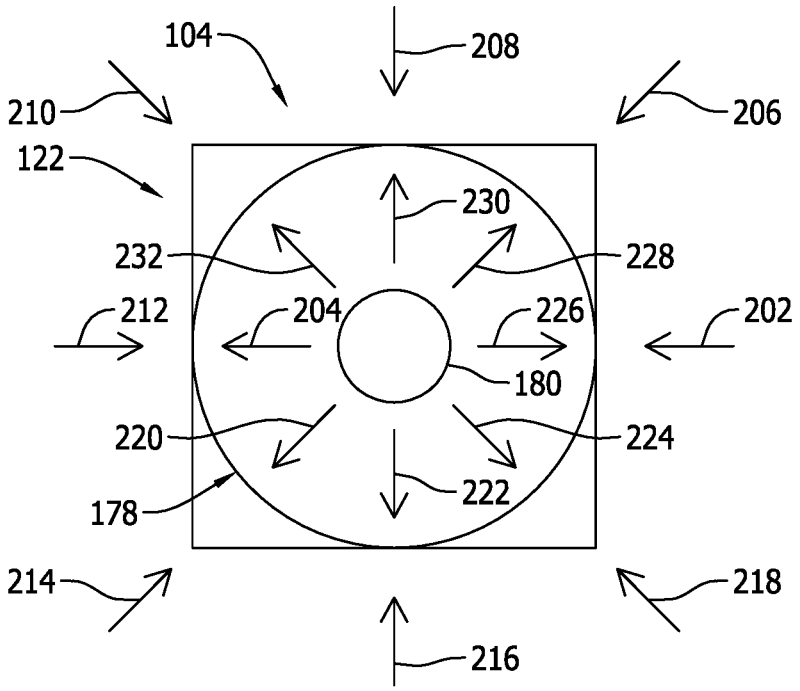
FIG. 6 is a force-movement diagram of a first, impacted support post of the sign structure shown in FIG. 1 during the stage of the collision shown in FIG. 5.
Figure 7:
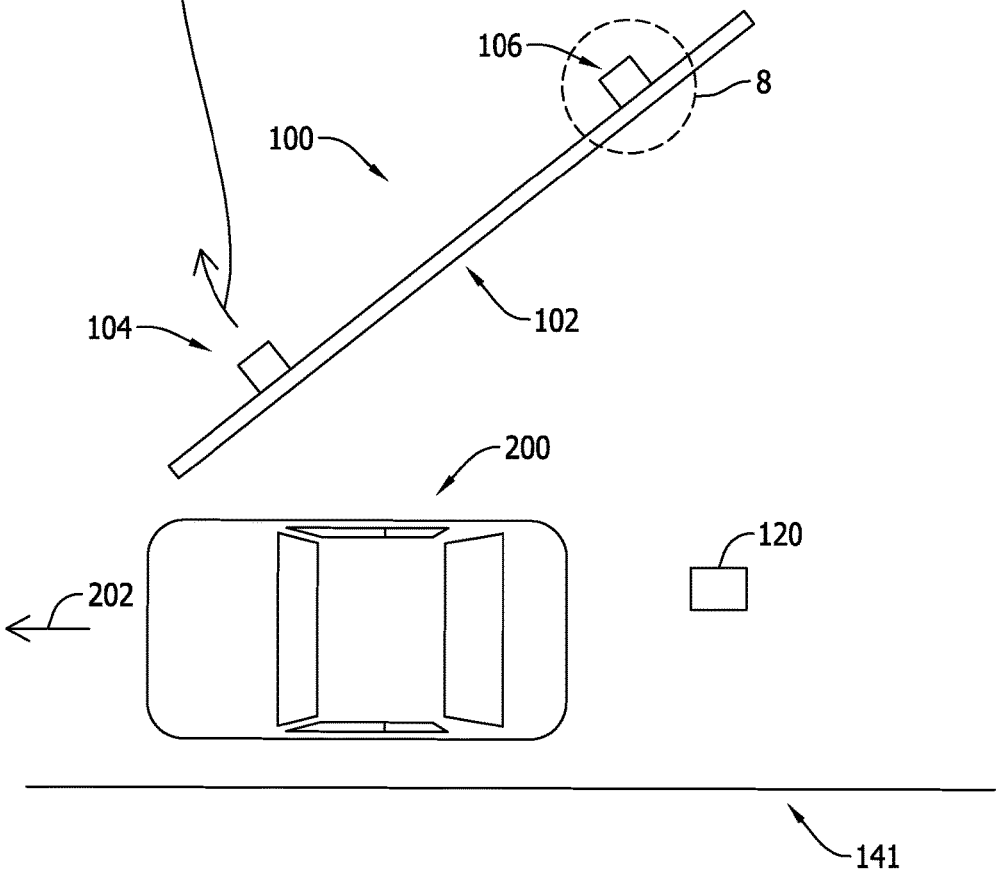
FIG. 7 is an overhead schematic illustration of the collision shown in FIG. 5 during a subsequent stage of the collision.

FIGS. 5-8 are various illustrations and diagrams of a vehicle 200 colliding with sign structure 100. In the exemplary embodiment, sign structure 100 is positioned alongside roadway 141 such that first support post 104 is closer to roadway 141 than second support post 106 (which is not illustrated in FIG. 5). As shown in FIG. 7, vehicle 200 collides with first support post 104 in this example, but vehicle 200 does not collide with second support post 106. Referring back to FIG. 5, when vehicle 200 impacts first support post 104 in a first lateral impact direction 202, base 120 disengages, and rod 176 hinges such that rod first end 180 pivots towards plane 177 in a first lateral pivot direction 204. Notably, as shown in FIG. 6, had vehicle 200 impacted first support post 104 in another lateral impact direction (e.g., a second lateral impact direction 206, a third lateral impact direction 208, a fourth lateral impact direction 210, a fifth lateral impact direction 212, a sixth lateral impact direction 214, a seventh lateral impact direction 216, or an eighth lateral impact direction 218), then rod 176 would have hinged such that first end 180 instead pivoted towards plane 177 in a corresponding lateral pivot direction (e.g., a second lateral pivot direction 220, a third lateral pivot direction 222, a fourth lateral pivot direction 224, a fifth lateral pivot direction 226, a sixth lateral pivot direction 228, a seventh lateral pivot direction 230, or an eighth lateral pivot direction 232, respectively). The hingeable-nature of joints 130 thereby facilitates reducing the reaction force imparted on vehicle 200 when vehicle 200 collides with a respective support post 104 or 106 of sign structure 100, by enabling the respective post first segment 122 to yield (or give way) to vehicle 200 no matter from which lateral direction vehicle 200 impacts the respective support post 104 or 106.

Figure 8:
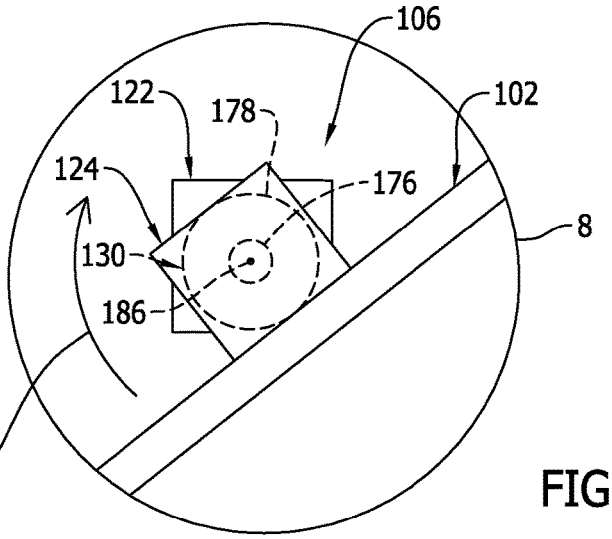
FIG. 8 is a motion diagram of a second support post of the sign structure shown in FIG. 1 during the stage of the collision shown in FIG. 7.

Moreover, as shown in FIGS. 7 and 8, the collision of vehicle 200 with first support post 104 causes first support post 104 (other than part of base 120 that remains grounded), panel 102, and post second segment 124 of second support post 106 to rotate in a rotational direction 234 about post first segment 122 of second support post 106 via joint 130 of second support post 106. More specifically, as shown in FIG. 8, post second segment 124 of second support post 106 rotates relative to post first segment 122 of second support post 106 about rod axis 186 of second support post 106 in rotational direction 234, such that post first segment 122, post second segment 124, and rod 176 of second support post 106 remain substantially coaxially aligned during the collision. The rotatable-nature of joints 130 thereby facilitates enabling sign structure 100 to swing out of the path of vehicle 200, as well as away from roadway 141, during the collision, and facilitates enabling second support post 106 to remain at least partly assembled throughout the collision. As a result, in the event that a vehicle 200 collides with sign structure 100, joints 130 work in tandem to facilitate mitigating damage to vehicle 200 and reducing the likelihood of injury to occupant(s) of vehicle 200.

In addition to the benefits described above, joints 130 also facilitate an easier and more cost-effective reassembly of sign structure 100 after the collision, in that many components of each respective joint 130 (e.g., first cap 144, second cap 148, and/or sleeve 178) are reusable. Moreover, joints 130 further enable sign structure 100 to be more easily installed in that, if foundations 117 (and/or bases 120) are inadvertently misaligned, the first and second segments 122 and 124, respectively, of each respective support post 104 and 106 can be rotated relative to one another at the respective joint 130 to facilitate compensating for the misalignment (i.e., the rotatable-nature of joints 130 effectively serves as a tolerance for improperly positioned foundations 117 and/or bases 120).

The methods and systems described herein facilitate providing a signpost joint with a hinge that enables multi-directional (or omni-directional) lateral movement of a first segment of the signpost relative to a second segment of the signpost. Moreover, the methods and systems facilitate providing a signpost joint that enables a signpost and a panel coupled to the signpost to swing away from the path of a vehicle that collides with the signpost. Thus, the methods and systems facilitate providing a signpost that reduces the reaction force imparted to a vehicle that collides with the signpost, and removes the signpost from the path of the vehicle in a quicker manner, thereby mitigating damage to the vehicle and reducing the likelihood of injury to occupant(s) of the vehicle. Additionally, the methods and systems facilitate the reassembly of a signpost impacted by a vehicle, and the methods and systems also facilitate the reuse of signpost joint components after a vehicle collides with the signpost. Furthermore, the methods and systems facilitate easier installation of a sign structure by providing a signpost joint that compensates for misalignment of signpost foundations and/or signpost bases when the sign structure is being installed.

Exemplary embodiments of signpost joints are described above in detail. The signpost joints described herein are not limited to the specific embodiments described herein but, rather, components of the signpost joints may be utilized independently and separately from other sign components described herein. For example, the signpost joints described herein may have other applications not limited to practice with road sign structures, as described herein. Rather, the signpost joints described herein can be implemented and utilized in connection with various other industries.

While the invention has been described in terms of various specific embodiments, those skilled in the art will recognize that the invention can be practiced with modification within the spirit and scope of the claims.

What is claimed is:

1. A signpost comprising:

a first segment;

a second segment; and a joint coupled between said first segment and said second segment, wherein said joint comprises:

a first cap coupled to said first segment;

a second cap coupled to said second segment;

a hollow rod coupled to said first and second caps in an orientation coaxial with said first and second segments, such that said hollow rod is rotatable about a hollow rod axis with respect to said first and second caps, wherein said hollow rod is deformably pivotable about a pivot axis perpendicular to the hollow rod axis in response to a lateral force applied to said first segment, and wherein a wall thickness of said hollow rod is less than at least one of a wall thickness of said first segment and a wall thickness of said second segment; and a sleeve coupleable between said first and second caps such that said sleeve circumscribes said hollow rod in spaced relation, and such that said first segment is rotatable relative to said second segment about the hollow rod axis, wherein said second cap is not adapted to be lockable against rotation about the hollow rod axis with respect to said first cap during an operational life of said signpost.

2. A signpost in accordance with claim 1, wherein the pivot axis is definable in any direction in a plane perpendicular to the hollow rod axis in response to a corresponding direction of the lateral force, such that said hollow rod defines an omni-directional hinge.

3. A signpost in accordance with claim 1, wherein said hollow rod is coupled to said first and second caps via respective threaded fasteners vertically aligned with said first and second segments.

4. A signpost in accordance with claim 1, wherein said second cap is rotatable relative to said first cap via pivotable deformation of said hollow rod.

5. A signpost in accordance with claim 1, wherein said hollow rod comprises a first end defining a first threaded bore and a second end defining a second threaded bore.

6. A sign structure comprising:

a panel; and a plurality of support posts coupled to said panel, each support post of said plurality of support posts comprising a first segment, a second segment, and a joint coupled between said first segment and said second segment, wherein said joint comprises:

a first cap coupled to said first segment;

a second cap coupled to said second segment;

a hollow rod coupled to said first and second caps in an orientation coaxial with said first and second segments, such that said hollow rod is rotatable about a hollow rod axis with respect to said first and second caps, wherein said hollow rod is deformably pivotable about a pivot axis perpendicular to the hollow rod axis in response to a lateral force applied to said first segment, and wherein a wall thickness of said hollow rod is less than at least one of a wall thickness of said first segment and a wall thickness of said second segment; and a sleeve coupleable between said first and second caps such that said sleeve circumscribes said hollow rod in spaced relation, and such that said first segment is rotatable relative to said second segment about the hollow rod axis.

7. A sign structure in accordance with claim 6, wherein the pivot axis is definable in any direction in a plane perpendicular to the hollow rod axis in response to a corresponding direction of the lateral force, such that said hollow rod defines an omni-directional hinge.

8. A sign structure in accordance with claim 6, wherein said hollow rod is coupled to said first and second caps via respective threaded fasteners vertically aligned with said first and second segments.

9. A sign structure in accordance with claim 6, wherein said second cap is rotatable relative to said first cap via pivotable deformation of said hollow rod.

10. A sign structure in accordance with claim 6, wherein said panel comprises a bottom edge, said joint of each of said plurality of signposts positioned adjacent said bottom edge.

11. A sign structure in accordance with claim 6, wherein each of said plurality of support posts comprises a multi-directional base.

12. A sign structure in accordance with claim 6, wherein said hollow rod comprises a first end defining a first threaded bore and a second end defining a second threaded bore.

* * * * *